US010278545B2

(12) United States Patent
Arab

(10) Patent No.: US 10,278,545 B2
(45) Date of Patent: May 7, 2019

(54) AUTOMATED HUMAN WASHING SYSTEMS

(71) Applicant: Anas Shakir Arab, Mekkah (SA)

(72) Inventor: Anas Shakir Arab, Mekkah (SA)

( * ) Notice: Subject to any disclaimer, the term of this patent is extended or adjusted under 35 U.S.C. 154(b) by 22 days.

(21) Appl. No.: 15/726,704

(22) Filed: Oct. 6, 2017

(65) Prior Publication Data

US 2018/0098669 A1 Apr. 12, 2018

Related U.S. Application Data

(60) Provisional application No. 62/404,845, filed on Oct. 6, 2016.

(51) Int. Cl.

| | |
|---|---|
| ***A47K 7/02*** | (2006.01) |
| ***A47K 3/28*** | (2006.01) |
| ***A47K 7/04*** | (2006.01) |
| ***A47K 10/48*** | (2006.01) |
| ***E03C 1/046*** | (2006.01) |
| ***E03C 1/05*** | (2006.01) |

(52) U.S. Cl.

CPC ..... *A47K 3/283* (2013.01); *A47K 3/282* (2013.01); *A47K 7/04* (2013.01); *A47K 10/48* (2013.01); *E03C 1/046* (2013.01); *E03C 1/055* (2013.01)

(58) Field of Classification Search

CPC ..... A47K 3/283; A47K 7/04; E03C 1/046; E03C 1/055

USPC ..... 4/606, 605, 601

See application file for complete search history.

(56) References Cited

U.S. PATENT DOCUMENTS

| | | | | |
|---|---|---|---|---|
| 3,091,776 A * | 6/1963 | Roberts | ..... | A47K 7/04 15/88.3 |
| 3,862,459 A * | 1/1975 | Brunette | ..... | A47K 7/04 15/88.3 |
| 3,884,191 A | 5/1975 | Stout | | |

(Continued)

FOREIGN PATENT DOCUMENTS

| | | |
|---|---|---|
| CN | 201051822 | 4/2008 |
| DE | 10012941 | 5/2001 |
| GB | 2412582 | 10/2005 |

OTHER PUBLICATIONS

International Search Report issued in corresponding International Application No. PCT/IB2017/001223, dated Mar. 15, 2018, 2 pages.

(Continued)

*Primary Examiner* — Huyen Le

(74) *Attorney, Agent, or Firm* — Doherty IP Law Group LLC

(57) ABSTRACT

An automated human washing system includes an enclosure having a base, a midsection, and a top cap. The enclosure has a front door. The system includes liquid dispensing tubes having openings for introducing liquid into the enclosure, and cleaning brushes having lower ends secured to the base. The liquid dispensing tubes are spaced from one another are surround the cleaning brushes. The system has a top cap including first and second top lids. The system has a main water faucet for introducing water into the upper end of the enclosure, a drain for removing liquid from the enclosure, a first engine for pumping liquid through the liquid dispensing tubes into the enclosure, a second engine for moving the elongated cleaning brushes over a top surface of the base, and a control system for operating the human washing system.

15 Claims, 15 Drawing Sheets

(56) References Cited

U.S. PATENT DOCUMENTS

| | | | | |
|---|---|---|---|---|
| 4,020,796 | A | 5/1977 | Grifa | |
| 4,056,078 | A | 11/1977 | Blafford et al. | |
| 4,505,229 | A | 3/1985 | Altissimo | |
| 4,741,289 | A | 5/1988 | Blose | |
| 4,782,792 | A | 11/1988 | Anthony et al. | |
| 5,418,985 | A * | 5/1995 | Antoine | E03C 1/063 4/601 |
| 5,662,069 | A | 9/1997 | Smith | |
| 6,047,416 | A * | 4/2000 | Carrier | A47K 10/48 4/596 |
| 6,581,219 | B1 * | 6/2003 | Powaska | A47K 7/04 4/606 |
| 7,100,538 | B2 | 9/2006 | Motomura | |
| 7,497,188 | B2 | 3/2009 | Cho | |
| 8,621,679 | B1 * | 1/2014 | Donikian | 15/21.1 |
| 2006/0169219 | A1 | 8/2006 | Yaghmai et al. | |
| 2009/0101077 | A1 | 4/2009 | Shaham | |
| 2011/0017147 | A1 | 1/2011 | Petruzzi | |
| 2012/0037085 | A1 | 2/2012 | Caisse | |
| 2015/0189857 | A1 | 7/2015 | Qirjazi | |

OTHER PUBLICATIONS

Written Opinion of the International Searching Authority issued in corresponding International Application No. PCT/IB2017/001223, dated Mar. 15, 2018, 4 pages.

* cited by examiner

AUTOMATED HUMAN WASHING SYSTEMS

CROSS-REFERENCE TO RELATED APPLICATIONS

The present patent application claims benefit of U.S. Provisional Application Ser. No. 62/404,845, filed Oct. 6, 2016, the disclosure of which is hereby incorporated by reference herein.

BACKGROUND OF THE INVENTION

Field of the Invention

The present patent application is generally related to washing and bathing tools for human beings, and is more specifically related to automated systems, devices, and methods for washing and drying human beings.

Description of the Related Art

There have been a number of developments directed to systems, devices and methods for washing humans and animals. For example, U.S. Pat. No. 5,539,939 to Gesse discloses a bathing apparatus for the infirm or disabled including a portable chair supported on adjustable legs. A depressed intermediate basin portion holds water and can receive the buttocks of a bather. It is provided with a drain at its lowermost portion. One end of the basin portion is connected to an upstanding backrest/headrest. A second end of the basin portion is connected to an elevated horizontal platform which serves as a thigh rest when the buttocks are in the basin in a first mode of operation. In a second mode of operation, the platform serves as a seat so that the user can slide into or out of the basin for less strenuous entry and exit when alone or assisted. A continuous smooth, water resistant surface covers platform, basin and backrest/headrest portions for comfort and ease of maintenance.

U.S. Pat. No. 7,055,187 to Fields discloses a bathing apparatus for use by disabled bathers, comprises a bathtub and a banister. The bathtub has a ramp and a floor. The ramp descends to the bathtub floor, which slopes gradually toward a drain. The ramp's top is approximately level with the seat of a wheel chair. The banister is coupled to the bathtub and extends over the ramp and floor of the bathtub. The banister has a sloped portion for descending into the bathtub that descends to level portion. The level portion is substantially horizontal for sitting or lying on while bathing. The level portion of the banister is over the floor and its height relative to floor increases as the floor slopes toward the drain. A bather may choose a seat height that is most comfortable by sitting on the level portion farther or closer to the drain. While bathing the bather is stabilized by the banister, feet or knees on the floor of the bathtub.

US 2017/0099805 to Arab, the disclosure of which is hereby incorporated by reference herein, discloses an automated animal washing system includes a housing having a base, and a wash tub for holding water and an animal cage positioned atop the base. The system has a lid moveable between a closed position for covering an upper end of the wash tub and an open position for providing access to the upper end of the wash tub. The system includes at least one water pipe for introducing water into the wash tub, and a shampoo pipe for introducing shampoo or soap into the wash tub. A rotatable agitator is disposed at the lower end of the wash tub. A drain is also disposed at the lower end of the wash tub for removing water from the wash tub. The animal cage is disposed inside the wash tub. The animal cage has spaced legs that project from a bottom of the cage for spacing the cage away from the rotatable agitator. A control system is disposed in the base for automatically operating the animal washing system.

In spite of the above advances, there remains a need for improved systems, devices and methods for safely and effectively washing and drying human beings.

SUMMARY OF THE INVENTION

In one embodiment, an automated human washing system includes an enclosure including a base, a midsection and a top cap. In one embodiment, the enclosure has a front wall having a front door moveable between open and closed positions.

In one embodiment, the system includes a plurality of liquid dispensing tubes having lower ends secured to the base and upper ends spaced from the base. In one embodiment, each liquid dispensing tube has a plurality of openings adapted for introducing liquid into the enclosure.

In one embodiment, the system includes a plurality of elongated cleaning brushes having lower ends secured to the base and upper ends spaced from the base.

In one embodiment, the liquid dispensing tubes are spaced from one another adjacent outer edges of the base, and the elongated cleaning brushes are located inside a perimeter defined by the liquid dispensing tubes.

In one embodiment, the top cap includes first and second top lids moveable between closed positions for covering an upper end of the enclosure and open positions for providing access to the upper end of the enclosure.

In one embodiment, the system includes a main water dispensing faucet located between the first and second top lids adjacent an upper end of the enclosure for introducing water into the upper end of the enclosure In one embodiment, the system includes a drain located at a lower end of the enclosure for removing liquid from the enclosure.

In one embodiment, the system has a first engine located in the base for pumping liquid through the liquid dispensing tubes into the enclosure, and a second engine located in the base for moving the elongated cleaning brushes over a top surface of the base.

In one embodiment, the system has a control system disposed in the base for automatically operating the automated human washing system including controlling the first and second engines.

In one embodiment, the enclosure has side walls that are transparent. In one embodiment, the enclosure is a double-walled structure. In one embodiment, the lower end of the enclosure forms a water tight seal with the base.

In one embodiment, the system includes chair leg openings formed in a top surface of the base, and moveable platforms disposed inside the chair leg openings that are configured to move up and down relative to the top surface of the base.

In one embodiment, the system includes a chair having legs positioned over the top surface of the base. In one embodiment, the legs of the chair are inserted into the chair leg openings, whereby the height of the chair relative to the top surface of the base is adjustable by moving the moveable platforms up and down within the chair leg openings.

In one embodiment, the system includes a hot air blower located on an underside of at least one of the first and second top lids. In one embodiment, each top lid has a hot air blower for directing hot, drying air into the enclosure.

In one embodiment, the first and second top lids open and close independently of one another, whereby the hot air blower has a first hot air blower located on an underside of the first top lid and a second hot air blower located on an underside of the second top lid, and whereby the main water dispensing faucet passes through an opening extending between the first and second top lids.

In one embodiment, the top cap includes a plurality of spaced vent openings formed in side walls of the top cap.

In one embodiment, the system includes a water inlet tube coupled with the enclosure and being in communication with the liquid dispensing tubes and the main water dispensing faucet for supplying water to the enclosure. In one embodiment, the system includes a drainage tube coupled with the enclosure and being in communication with a drain for removing water from the enclosure.

In one embodiment, each liquid dispensing tube extends vertically between the lower and upper ends of the enclosure. In one embodiment, each liquid dispensing tube has a plurality of spaced openings for introducing water into the enclosure.

In one embodiment, the system includes a solution reservoir located on the base. In one embodiment, the solution reservoir includes at least one of a soap compartment, a shampoo compartment, and a conditioner compartment.

In one embodiment, the control system includes a central processing unit containing one or more operational protocols for controlling operation of the automated human washing system, one or more memory devices, and circuitry for controlling operation of the automated human washing system.

In one embodiment, the system has a first engine for controlling movement of the elongated cleaning brushes, a second engine for pumping water into the enclosure of the automated human washing system, and a third engine for pumping solutions selected from the group consisting of soap, shampoo and conditioner into the liquid dispensing tubes of the automated human washing system.

In one embodiment, the system may include a fourth engine for providing drying hot air and/or high pressure air through the hot air blowers provided on the underside of the first and second top lids. In one embodiment, the system includes a fifth engine including a hydraulic lift for raising and lowering the height of a chair inserted into the chair leg openings provided in the top surface of the base.

In one embodiment, the system includes cleaning brush slots formed in a top surface of the base. In one embodiment, the lower ends of the elongated cleaning brushes are inserted into the cleaning brush slots, whereby the elongated cleaning brushes are configured to move back and forth over the top surface of the base by moving through the cleaning brush slots. The lower ends of the elongated cleaning brushes may be coupled with a motor for driving the movement of the cleaning brushes over a path. The path may be reciprocating.

In one embodiment, an automated human washing system preferably includes an enclosure including a base, a midsection and a top cap, the enclosure including a front wall having a front door moveable between open and closed positions.

In one embodiment, the system includes a plurality vertically extending tubes having lower ends secured to the base, whereby each vertically extending tube has a plurality of openings adapted for introducing liquid into the enclosure.

In one embodiment, the system includes a plurality of vertically extending, elongated cleaning brushes having lower ends secured to the base, whereby the vertically extending tubes are spaced from one another for defining an outer perimeter, and whereby the vertically extending, elongated cleaning brushes are located inside the outer perimeter defined by the vertically extending tubes In one embodiment, the top cap has first and second top lids moveable between closed positions for covering an upper end of the enclosure and open positions for providing access to the upper end of the enclosure.

In one embodiment, the system has a main water dispensing faucet located between the first and second top lids for introducing water into the upper end of the enclosure, and a drain located at a lower end of the enclosure for removing liquid from the enclosure.

In one embodiment, the system has an engine located in the base for moving the elongated cleaning brushes over a top surface of the base, and a control system disposed in the base for automatically operating the human washing system including controlling the engine.

These and other preferred embodiments of the present invention will be described in more detail below.

DETAILED DESCRIPTION OF PREFERRED EMBODIMENTS

Figure 1:
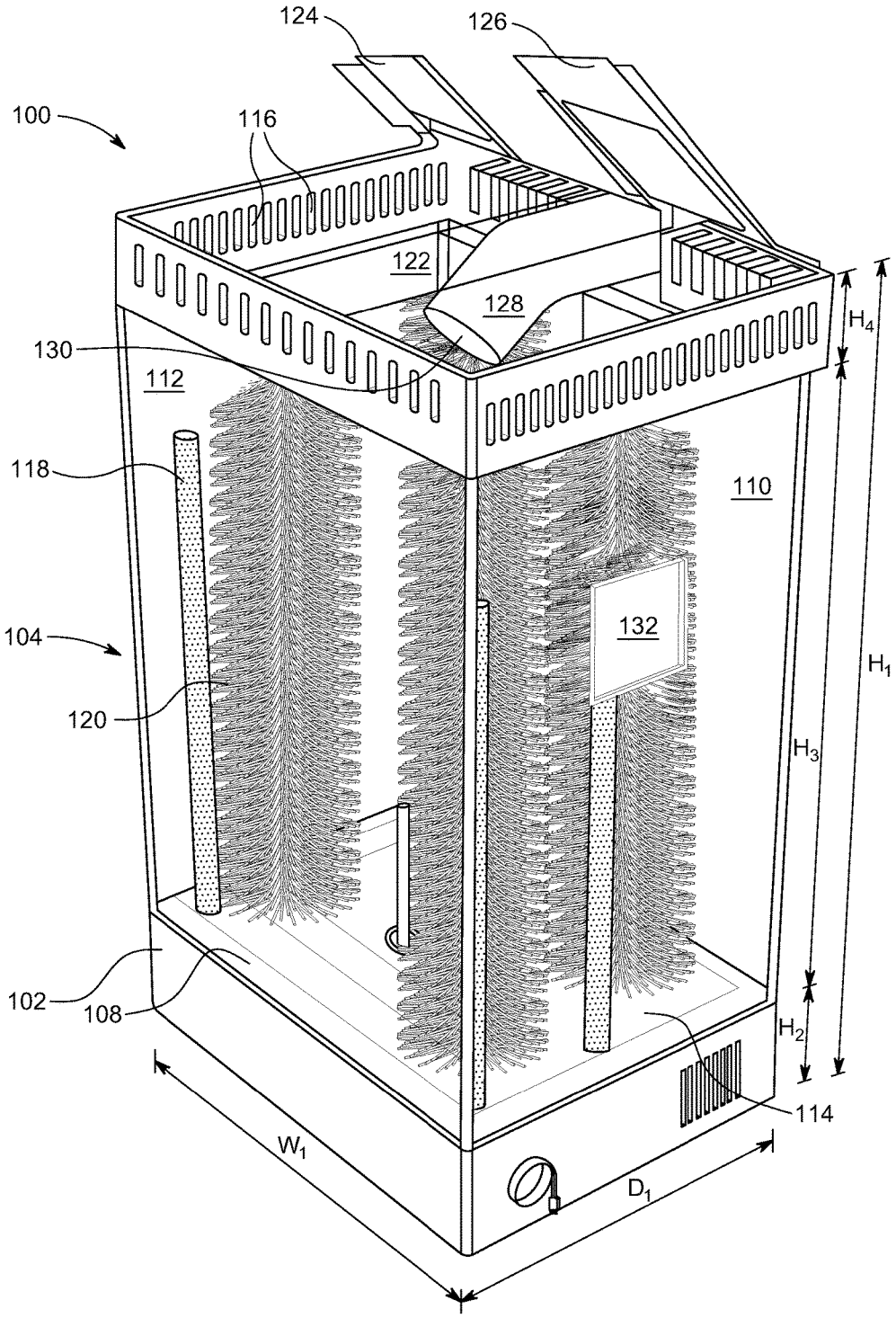
FIG. 1 shows a perspective view of an automated human washing system, in accordance with one embodiment.

Referring to FIG. 1, in one embodiment, an automated human washing system 100 has a base 102, a midsection 104 (e.g., an enclosed area occupied by a human for bathing), and a cap 106 that is secured to an upper end of the midsection 104. In one embodiment, the midsection is a transparent midsection that is clear and/or allows visibility into and out of the automated human washing system. In one embodiment, the automated human washing system 100 preferably defines a rectangular shaped structure having a height $H_1$ of about 75-80 inches and more preferably about 78.74 inches, a width $W_1$ of about 45-50 inches and more preferably about 47.24 inches, and a depth $D_1$ of about 30-40 inches and more preferably 35.43 inches.

In one embodiment, the base 102 preferably defines a height $H_2$ of about 10-12 inches and more preferably 11.81 inches. In one embodiment, the transparent midsection 104 has a height $H_3$ of about 50-60 inches and more preferably about 59.05 inches. In one embodiment, the top cap 106 has a height $H_4$ of about 7-9 inches and more preferably about 7.87 inches.

In one embodiment, the base 102 and the top cap 106 are opaque and the transparent midsection 104 is clear so that the interior of the automated human washing system may be observed through the transparent midsection, and so that light may pass through the side walls of the midsection.

In one embodiment, the automated human washing system 100 preferably includes four transparent walls that extend between the base 102 and the top cap 106. In one embodiment, the four transparent walls include a front wall 108, a rear wall 110, a left side wall 112, and a right side wall 114. The four walls 108, 110, 112, 114 preferably are connected together and form a unitary structure that extends between the base 102 and the top cap 106. In one embodiment, the transparent midsection comprises a double-walled enclosure.

In one embodiment, the top cap 106 defines a frame that extends around the upper ends of the four walls 108, 110, 112, 114. In one embodiment, the top cap 106 preferably includes vent openings 116 that extend around the perimeter of the top cap 106 for enabling air to pass into and out of the automated human washing system 100. In one embodiment, the vent openings extend vertically and are spaced from one another by a distance $D_2$ of about 1.5-2.5 inches and more preferably about 1.96 inches.

In one embodiment, the automated human washing system 100 includes a plurality of liquid dispensing tubes 118 that are positioned inside the automated human washing system. In one embodiment, the liquid dispensing tubes 118 extend vertically within the automated human washing system 100 and have a plurality of openings 125 (FIG. 7B) provided along the length thereof for dispensing liquid such as water and shampoo into the interior of the automated human washing system. The openings in the liquid dispensing tubes may be provided on the sides of the respective tubes that face toward an occupant or may be spaced completely around the outer surfaces of the tubes.

In one embodiment, the automated human washing system 100 includes cleaning brushes 120 that are located inside the automated human washing system 100 for cleaning a human being. In one embodiment, the cleaning brushes 120 are adapted to move through tracks provided in the base 102 for cleaning a human being. The movement of the cleaning brushes may be driven by a motor located in the base to provide a back and forth scrubbing movement for cleaning a human being disposed inside the automated human washing system.

In one embodiment, the automated human washing system 100 includes a top panel 122 that extends between a front edge and a rear edge of the top cap 106. In one embodiment, the top panel 122 is transparent for providing visibility therethrough.

In one embodiment, the automated human washing system 100 preferably includes a first top lid 124 having a rear edge hingedly connected with the rear of the top cap 106. The first top lid 124 is adapted to swing between an open position for providing access to the top of the automated human washing system and a closed position for covering the upper end of the top cap 106 of the automated human washing system. In one embodiment, the automated human washing system 100 includes a second top lid 126 having a rear edge that is hingedly connected with a rear of the top cap 106 for moving between an open position for providing access to the top of the automated human washing system and a closed position for closing the upper end of the top cap 106.

In one embodiment, the automated human washing system 100 includes a main water dispensing faucet 128 having an opening 130 that is adapted to dispense liquid, such as water, onto a top of a human being positioned within the automated human washing system 100.

In one embodiment, the automated human washing system 100 includes a control panel 132 that may be engaged by an operator for controlling the operation of the automated human washing system 100.

Figure 2:
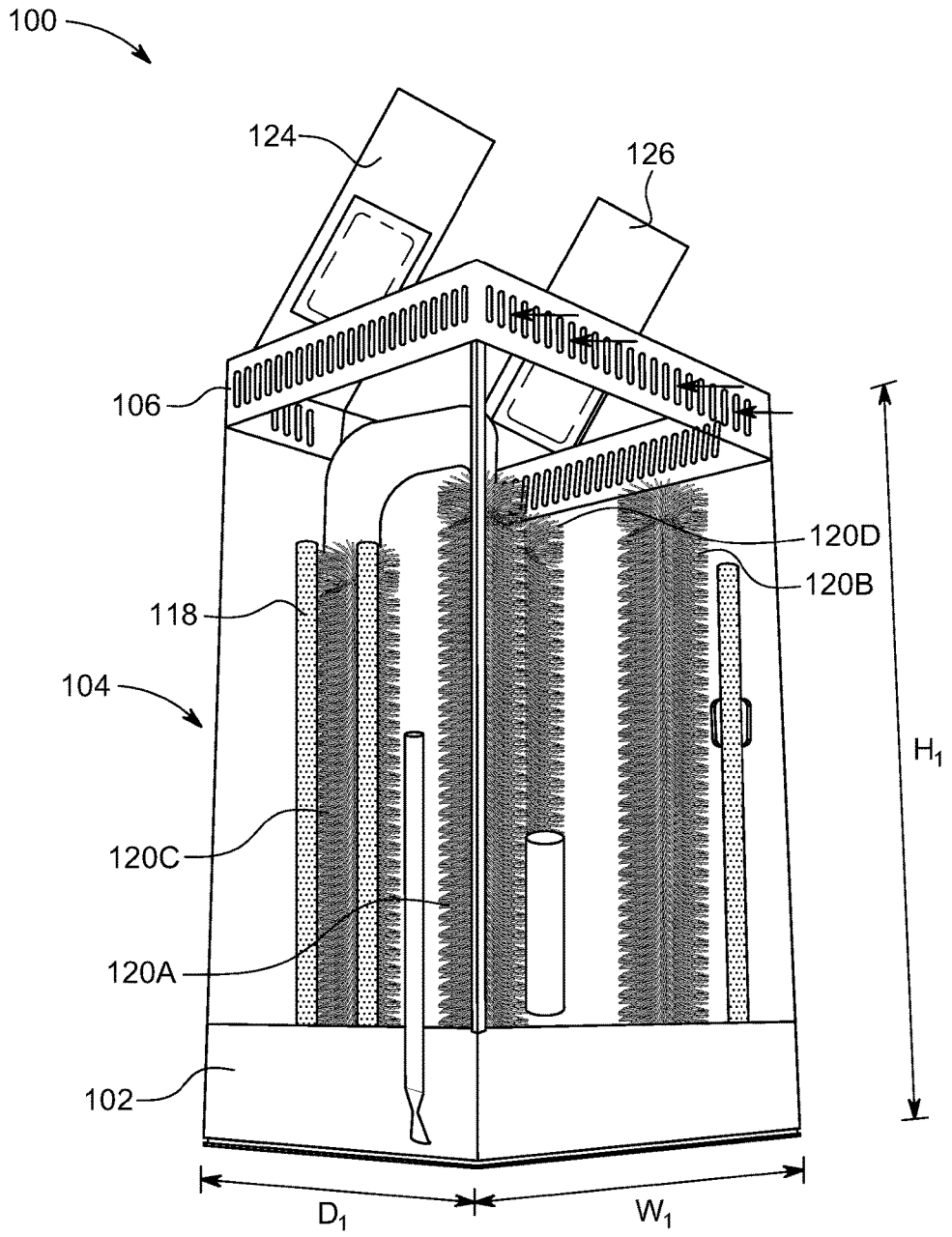
FIG. 2 shows another perspective view of the automated human washing system of FIG. 1

Referring to FIG. 2, in one embodiment, the automated human washing system 100 preferably includes four cleaning brushes 120A-120D having lower ends that are secured within tracks located on the base 102. The four cleaning brushes 120A-120D are preferably disposed inside the four transparent walls of the transparent midsection 104. In one embodiment, the four cleaning brushes 120A-120D are disposed inside an outer perimeter defined by the liquid dispensing tubes 118.

In one embodiment, the top cap 106 preferably includes a plurality of vent holes 116 for enabling air to pass into and out of the automated human washing system when the first and second top lids 124, 126 are moved into the closed position.

Figure 3:
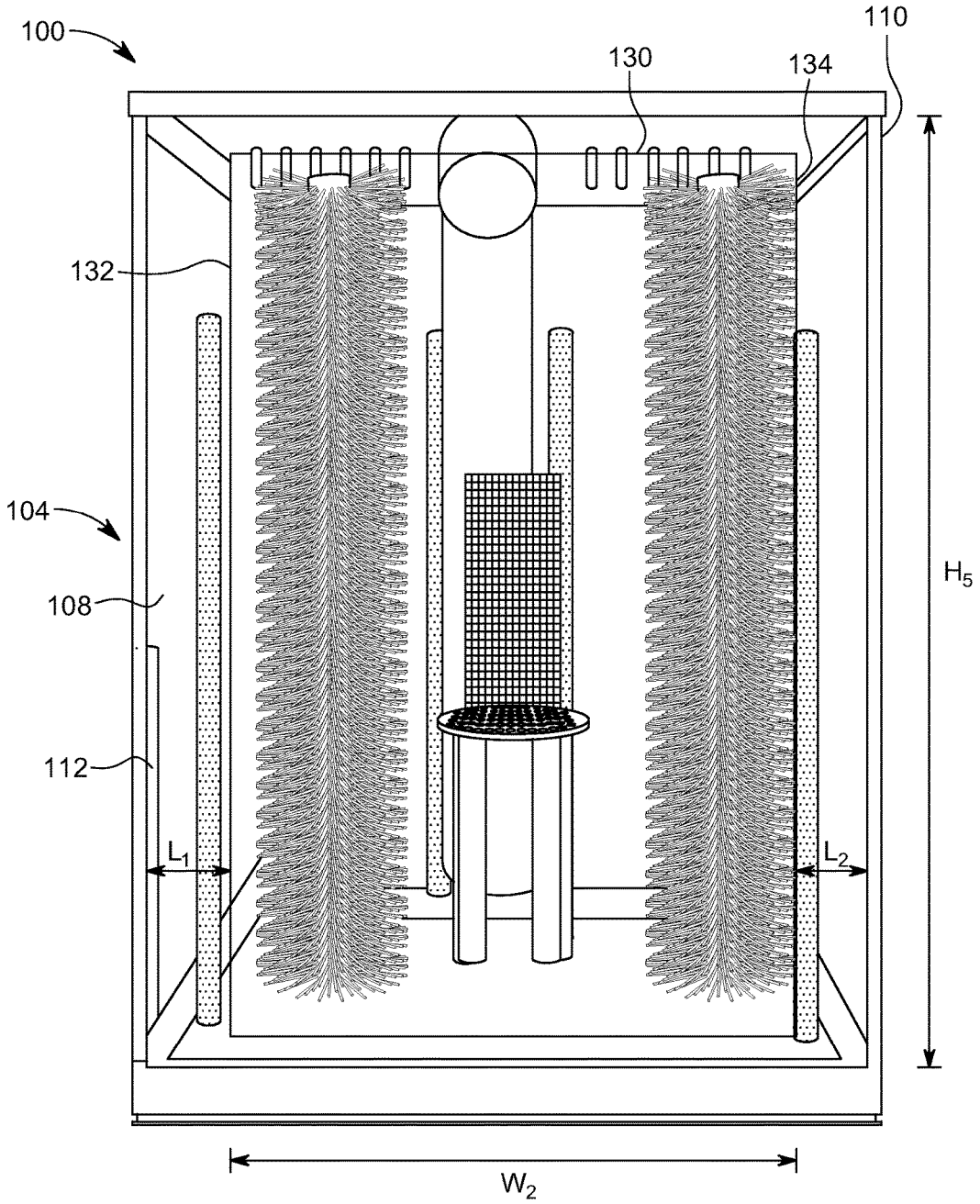
FIG. 3 shows a front view of an automated human washing system, in accordance with one embodiment.

Referring to FIG. 3, in one embodiment, the automated human washing system 100 includes a front door 130 that is formed in the front wall 108 of the transparent midsection 104. In one embodiment, the front wall 130 is transparent for providing visibility into the interior of the automated human washing system 100. In one embodiment, the front door 130 has a height $H_5$ of about 50-60 inches and more preferably about 55.11 inches and a width $W_2$ of about 30-40 inches and more preferably about 35.43 inches. In one embodiment, the door 130 is hinged on the left side 132 thereof and is adapted to open to the outside of the automated human washing system 100. In one embodiment, the left side 132 of the door 130 is spaced a length $L_1$ of about 5-6 inches and more preferably about 5.90 inches from the transparent left wall 112. In one embodiment, the door 130 has a right side 134 that is spaced a distance $L_2$ of about 5-6 inches and more preferably about 5.90 inches from the transparent right wall 110 of the automated human washing system 100. In one embodiment, the door 130 may have handles on the inside and/or the outside of the door for moving the door between open and a closed position.

Figure 4:
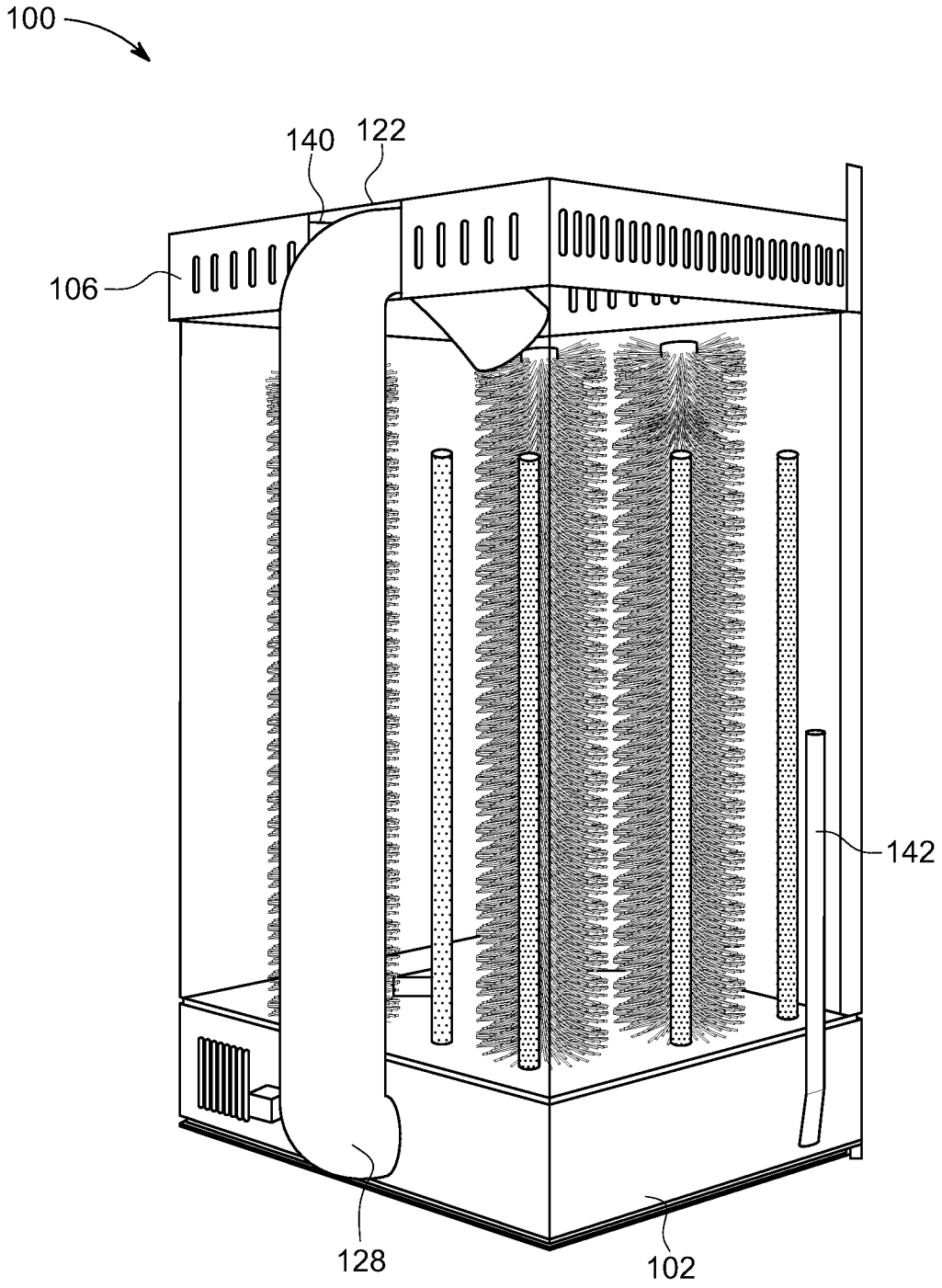
FIG. 4 shows a rear perspective view of the automated human washing system of FIG. 3.

Referring to FIG. 4, in one embodiment, the automated human washing system 100 preferably includes the main water dispensing faucet 128 having a lower end coupled with the base 102 and an upper end that passes through an opening 140 formed in the rear of the top cap 106. The upper end of the main water dispensing faucet 128 is covered by the top panel 122 (FIG. 1) that extends between the rear and the front of the top cap 102.

In one embodiment, the automated human washing system 100 includes a flexible drainage tube 142 that enables liquid to be drained from the automated human washing system, such as the base of the automated human washing system. In one embodiment, the base includes one or more drains and the water drained through the one or more drains passes through the flexible drainage tube 142.

Figure 5:
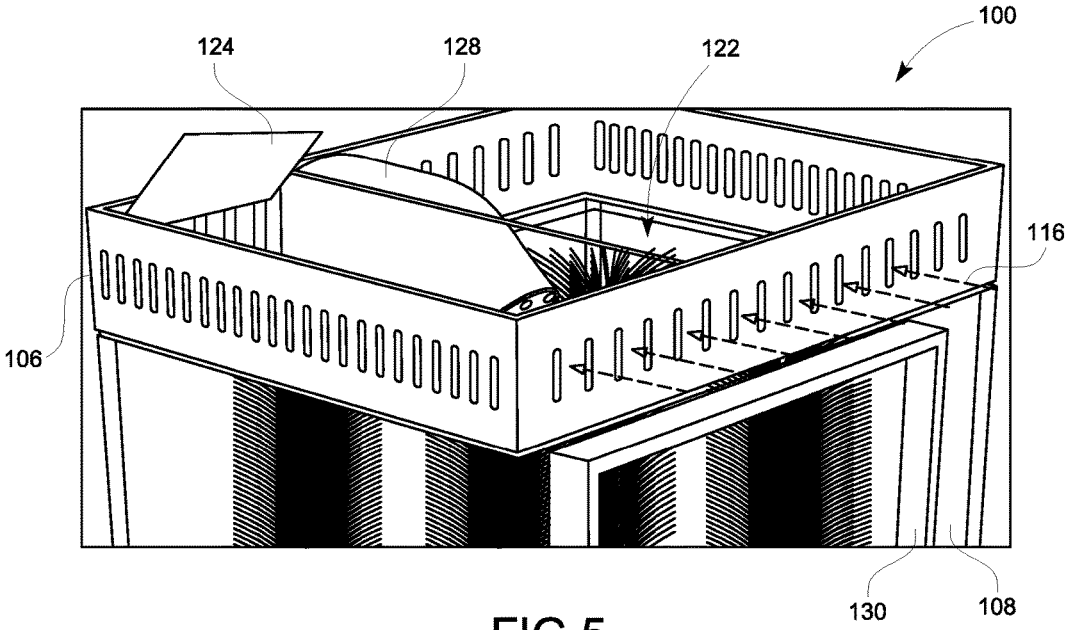
FIG. 5 shows an upper end of an automated human washing system, in accordance with one embodiment.

Referring to FIG. 5, in one embodiment, the front door 130 is preferably hingedly secured to the front transparent wall 108 of the automated human washing system 100. The top cap 106 covers the upper ends of the four transparent walls 108, 110, 112, 114 (FIG. 1). The transparent top panel 122 extends between the front and the rear of the top cap 106 for covering the upper end of the main water dispensing faucet 128. The perimeter of the top cap 106 preferably includes a series of spaced vent openings 116. The spaced vent openings 116 preferably enable air to pass into and out of the automated human washing system 100 when the first and second top lids 124, 126 (FIG. 1) are closed on either side of the transparent top panel 122.

Figure 6:
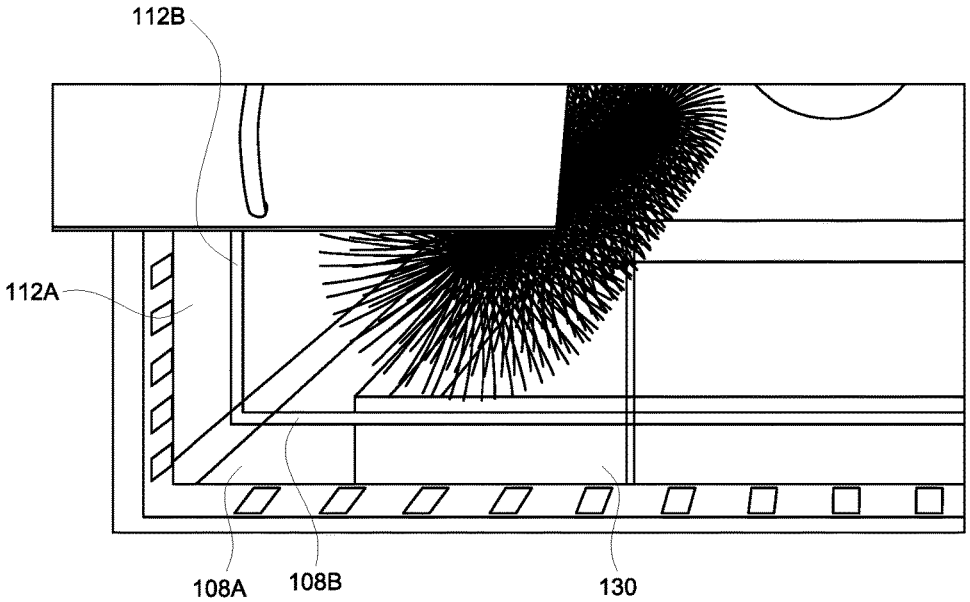
FIG. 6 shows a top view of an automated human washing system, in accordance with one embodiment.

Referring to FIG. 6, in one embodiment, an automated human washing system 100 preferably includes a double walled transparent midsection 104 (FIG. 1) having four transparent outer walls 108, 100, 112, 114 (FIG. 1) that surround four transparent inner walls. In FIG. 6, a front outer transparent wall 108A is spaced away from a front transparent inner wall 108B, and a left transparent outer wall 112A is spaced away from a left transparent inner wall 112B. A similar structure exists for the right transparent wall and the rear transparent wall of the automated human washing system. In one embodiment, the inner transparent walls of the automated human washing system are spaced a distance $L_3$ of about 1.5-2.5 inches and more preferably about 1.96 inches from the outer transparent wall associated therewith. In one embodiment, the four inner walls and the four outer walls are joined together in a unitary structure.

In one embodiment, the automated human washing system 100 preferably includes a front door 130 having a left side 132 that is hingedly secured to the front transparent outer wall 108A for enabling the front door 130 to swing between open and closed positions.

Figure 7A:
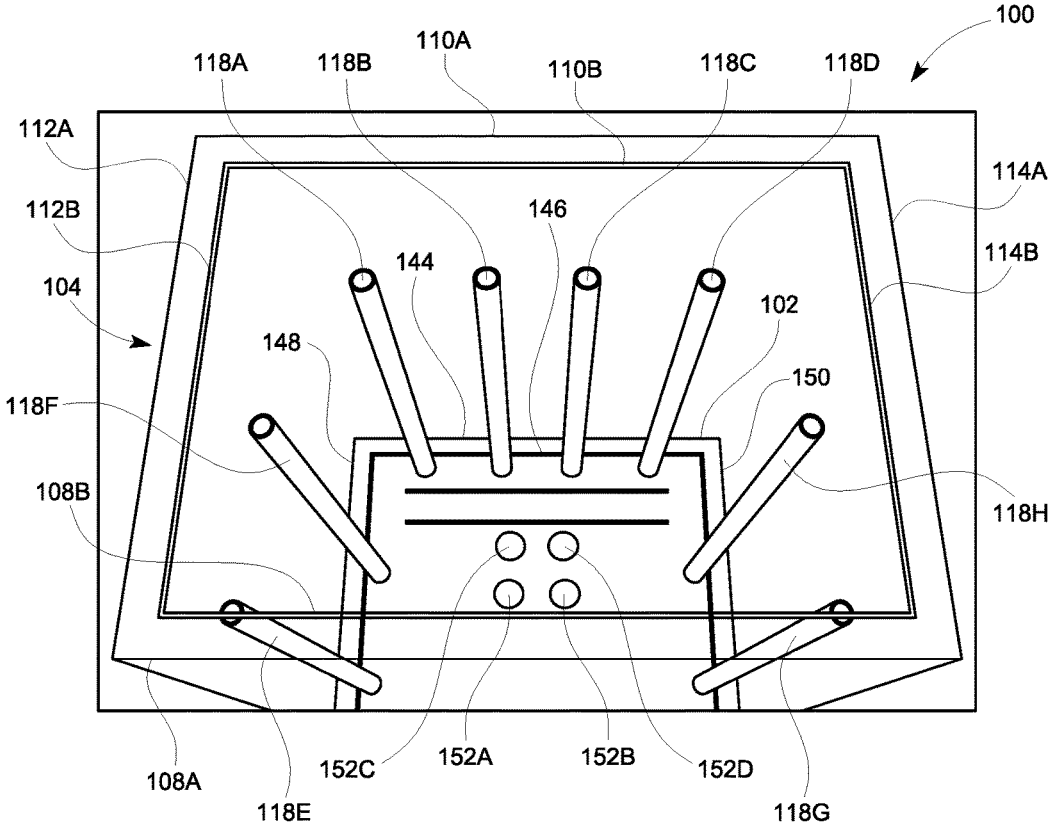
FIG. 7A shows a top perspective view of an automated human washing system, in accordance with one embodiment.
Figure 7B:
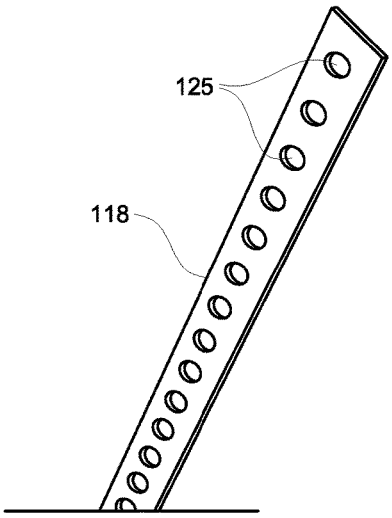
FIG. 7B shows a perspective view of a liquid dispensing tube, in accordance with one embodiment.

Referring to FIG. 7, in one embodiment, an automated human washing system 100 preferably includes a transparent midsection 104 that extends upwardly from a base 102. The lower end of the transparent midsection is preferably secured to the base 102. In one embodiment, the transparent midsection 104 of the automated human washing system 100 preferably defines a double walled container having transparent outer walls 108A, 110A, 112A, and 114A that surround transparent inner walls 108B, 110B, 112B and 114B. The transparent outer walls 108A, 110A, 112A and 114A form a unitary structure having a lower end that is secured to the base 102. Similarly, the transparent inner walls 108B, 110B, 112B and 114B form a unitary structure and have lower ends that are secured to the base 102. The transparent inner walls are spaced inwardly from and surrounded by the transparent outer walls to form the double walled transparent midsection 104 (e.g., a water-tight washing enclosure).

In one embodiment, the automated human washing system 100 desirably includes liquid dispensing tubes 118A-118D that extend adjacent a rear edge of the base 102. As described above, the liquid dispensing tubes 118A-118D have lower ends secured to the base 102 and a plurality of openings formed in each of the outer walls thereof for dispensing liquids such as water, shampoo, and/or conditioner into the interior of the automated human washing system 100. In one embodiment, the automated human washing system 100 preferably includes liquid dispensing tubes 118E and 118F located adjacent the left side of the base 102 and liquid dispensing tubes 118G and 118H located adjacent the right side of the base 102.

In one embodiment, the base 102 has a top face 144 having cleaning brush tracks 146 formed therein that extend between the left side 148 and the right side 150 of the base 102. In one embodiment, the cleaning brush tracks 146 are preferably parallel to one another. In one embodiment, the top surface 144 of the base 102 includes spaced chair leg openings 152A-152D that are adapted to receive the lower ends of the legs of a chair placed inside the transparent midsection 104 of the automated human washing system 100.

Figure 8:
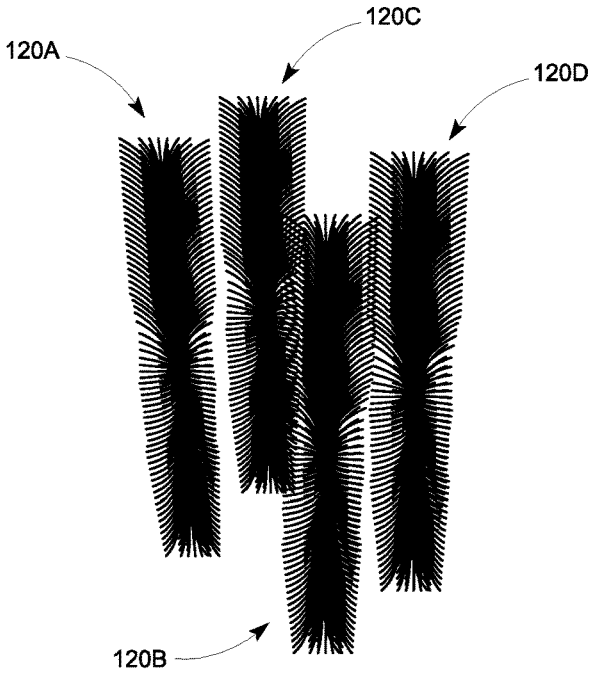
FIG. 8 shows cleaning brushes for an automated human washing system, in accordance with one embodiment.

Referring to FIG. 8, in one embodiment, the automated human washing system 100 (FIG. 1) may include cleaning brushes 120A-120D. In one embodiment, the cleaning brushes include front cleaning brushes 120A, 120B having lower ends that are inserted into the cleaning brush tracks adjacent the front edge of the base, and rear cleaning brushes 120C, 120D having lower ends that are inserted into the cleaning brush tracks adjacent the rear edge of the base. In one embodiment, the cleaning brushes 120A-120D have a height $H_6$ of about 55-65 inches and more preferably about 59.05 inches. In one embodiment, the cleaning brushes have a cylindrical shape. In one embodiment, the cleaning brushes have bristles.

Figure 9:
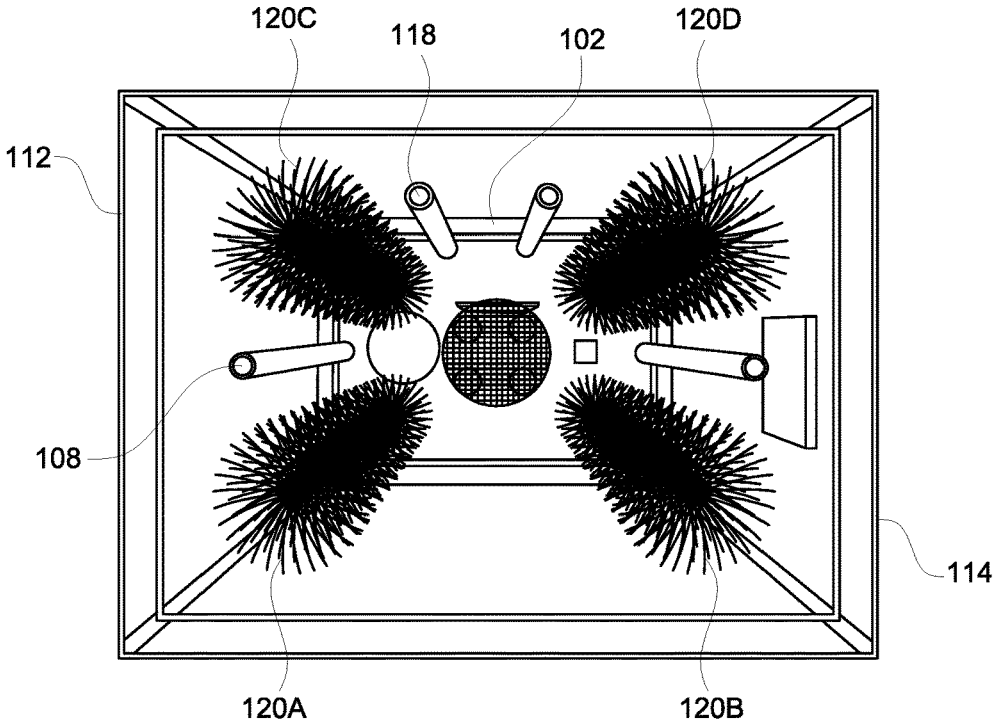
FIG. 9 shows the cleaning brushes of FIG. 8 assembled with a base of an automated human washing system, in accordance with one embodiment.

Referring to FIG. 9, in one embodiment, the first cleaning brush 120A has a lower end mounted in a first cleaning brush track adjacent a leading edge of the base 102 and a second cleaning brush 120B has a lower end inserted into a second cleaning brush track adjacent the front edge of the base 102. The first and second cleaning brushes are preferably offset from one another and follow different paths when moving. Similarly, a third cleaning brush 120C has a lower end inserted into a cleaning brush track adjacent a rear edge of the base, and a fourth cleaning brush 120D has a lower edge inserted into a cleaning brush track adjacent a rear edge of the base 102. The third and fourth cleaning brushes preferably travel in different paths. In one embodiment, the base 102 contains a cleaning brush motor that moves the respective cleaning brushes 120A-120D from the left side wall 112 to the right side wall 114 by reciprocating the brushes back and forth in the directions designated $DIR_1$ and $DIR_2$. In one embodiment, the cleaning brushes 120A-120D are positioned within the perimeter of the vertically extending liquid dispensing tubes 118. The cleaning brushes may scrub an occupant as they move back and forth for cleaning the occupant.

Figure 10:
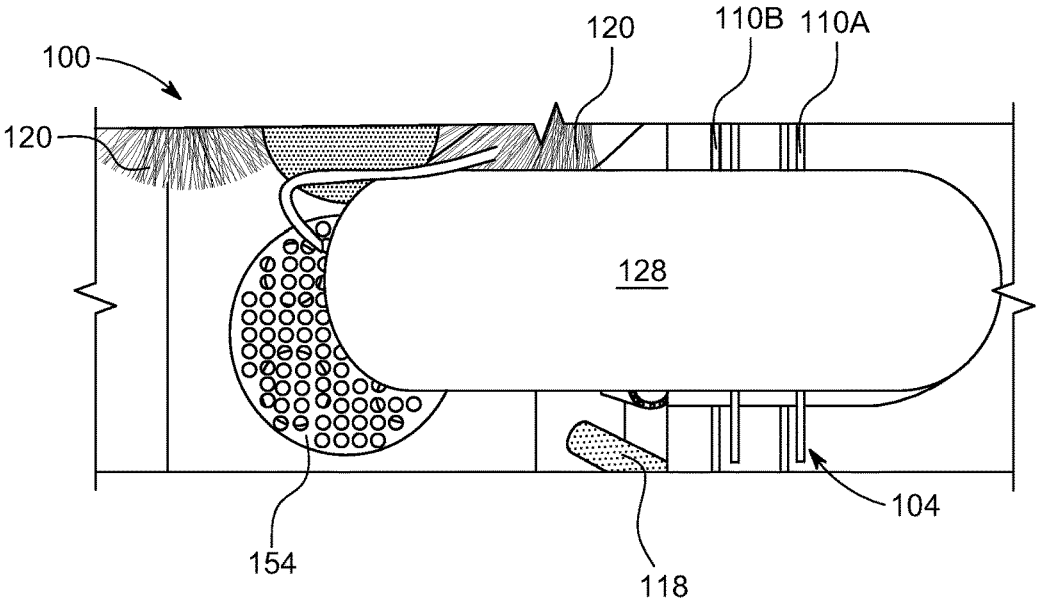
FIG. 10 shows a top view of a main water faucet for an automated human washing system, in accordance with one embodiment.
Figure 11:
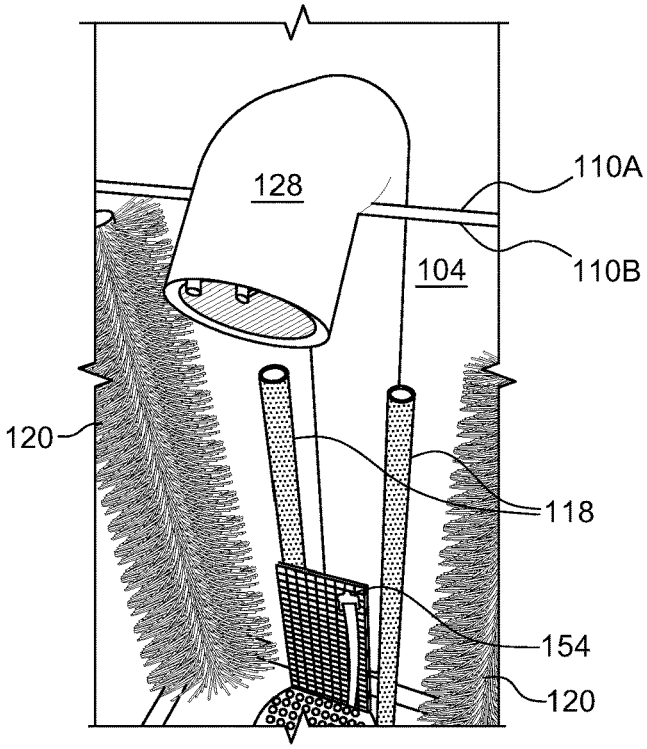
FIG. 11 shows a perspective view of an upper end of a main water faucet for an automated human washing system, in accordance with one embodiment.

Referring to FIGS. 10 and 11, in one embodiment, the main water dispensing faucet 128 has a curved upper end that passes over the top of the transparent rear outer wall 110A and the transparent rear inner wall 110B that defines the double walled transparent midsection 104 (FIG. 1). The vertically extending liquid dispensing tubes 118, and the cleaning brushes 120 are preferably located inside the double walled container defining the transparent midsection 104 of the automated human washing system 100.

In one embodiment, a chair 154 is preferably positioned inside the transparent midsection 104 of the automated human washing system 100. The vertically extending liquid dispensing tubes 118 may have heights that extend above the height of the chair 154 (FIG. 11). The upper end of the main water dispensing faucet 128 is preferably adapted to be in general alignment with the chair 154 for dispensing water atop the chair.

Figure 12:
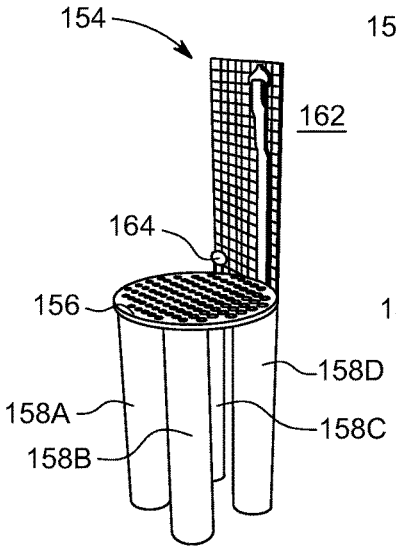
FIG. 12 shows a perspective view of a chair for an automated human washing system, in accordance with one embodiment.

Referring to FIG. 12, in one embodiment, a chair 154 includes a horizontally extending seating surface 156 that may be porous and four legs 158A-158D that extend downwardly from an underside of the horizontally extending seating surface 156. In one embodiment, the chair 154 includes a vertically extending back 160 extending upwardly from the horizontally extending seating surface 156 for supporting the back of a person sitting on the chair 154. In one embodiment, the vertically extending back 160 is preferably porous for enabling water and/or liquid to pass therethrough. In one embodiment, the chair 154 includes a securing belt 162 and a buckle 164 for securing a person atop the chair 154.

Figure 13:
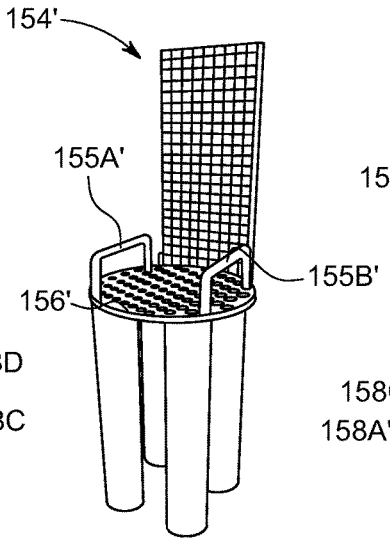
FIG. 13 shows a perspective view of a second chair for an automated human washing system, in accordance with one embodiment.

Referring to FIG. 13, in one embodiment, a chair 154' that is similar to that shown in FIG. 12 includes first and second arm supports 155A', 155B' secured to the sides of the horizontally extending seating surface 156'.

Figure 14:
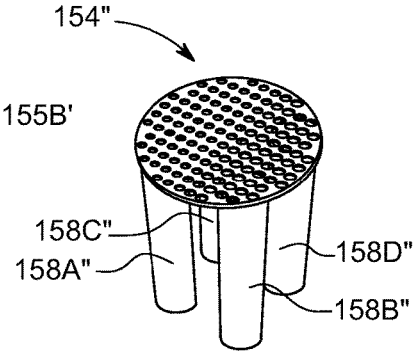
FIG. 14 shows a perspective view of a third chair for an automated human washing system, in accordance with one embodiment.

Referring to FIG. 14, in one embodiment, a chair 154" preferably include a horizontally extending seated surface 156" and four legs 158A"-158D" extending downwardly from an underside of the horizontally extending seating surface 156".

Figure 15:
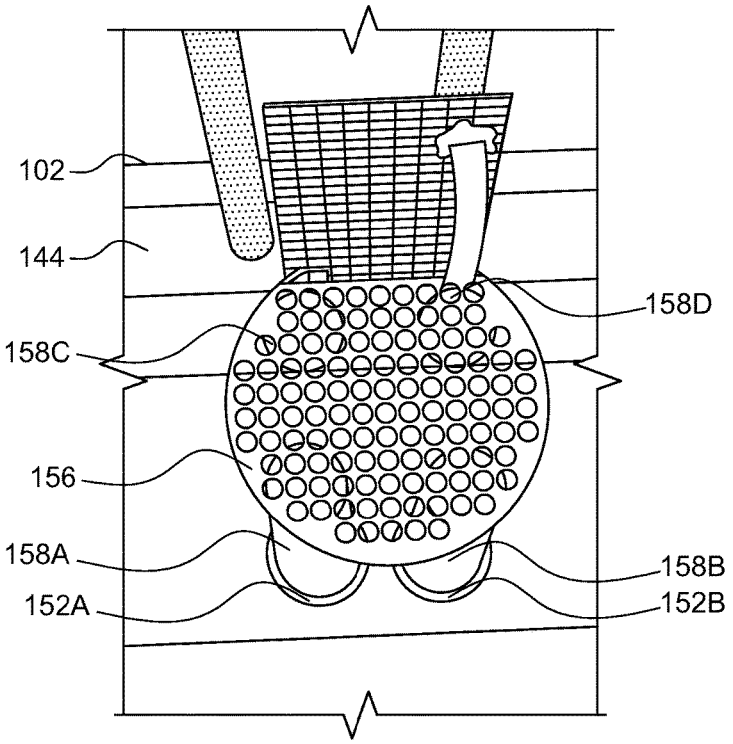
FIG. 15 shows a top view of a chair secured to a base of an automated human washing system, in accordance with one embodiment.

Referring to FIG. 15, in one embodiment, a chair 154 is positioned inside the double wall transparent midsection 104 (FIG. 1) of the automated human washing system with the four legs 158A-158D inserted into the chair leg openings 152A-152D (FIG. 7) formed in the top surface 144 of the base 102. In one embodiment, the chair leg openings 152A-152D include moveable platforms that are part an elevator mechanism coupled with a motor disposed within the base 102. The moveable platforms support the lower ends of the chair legs and are configured to selectively move up and down relative to the top surface 144 of the base for selectively moving the chair legs up and down to adjust the height of the chair relative to the top surface 144 of the base 102. In one embodiment, the height of the chair may be adjusted up and down for accommodating individuals having different heights. In one embodiment, the moveable platforms are located below the top surface of the base so that the lower ends of the chair legs fit within the chair leg openings for preventing horizontal movement of the chair legs relative to the top surface of the base.

Figure 16:
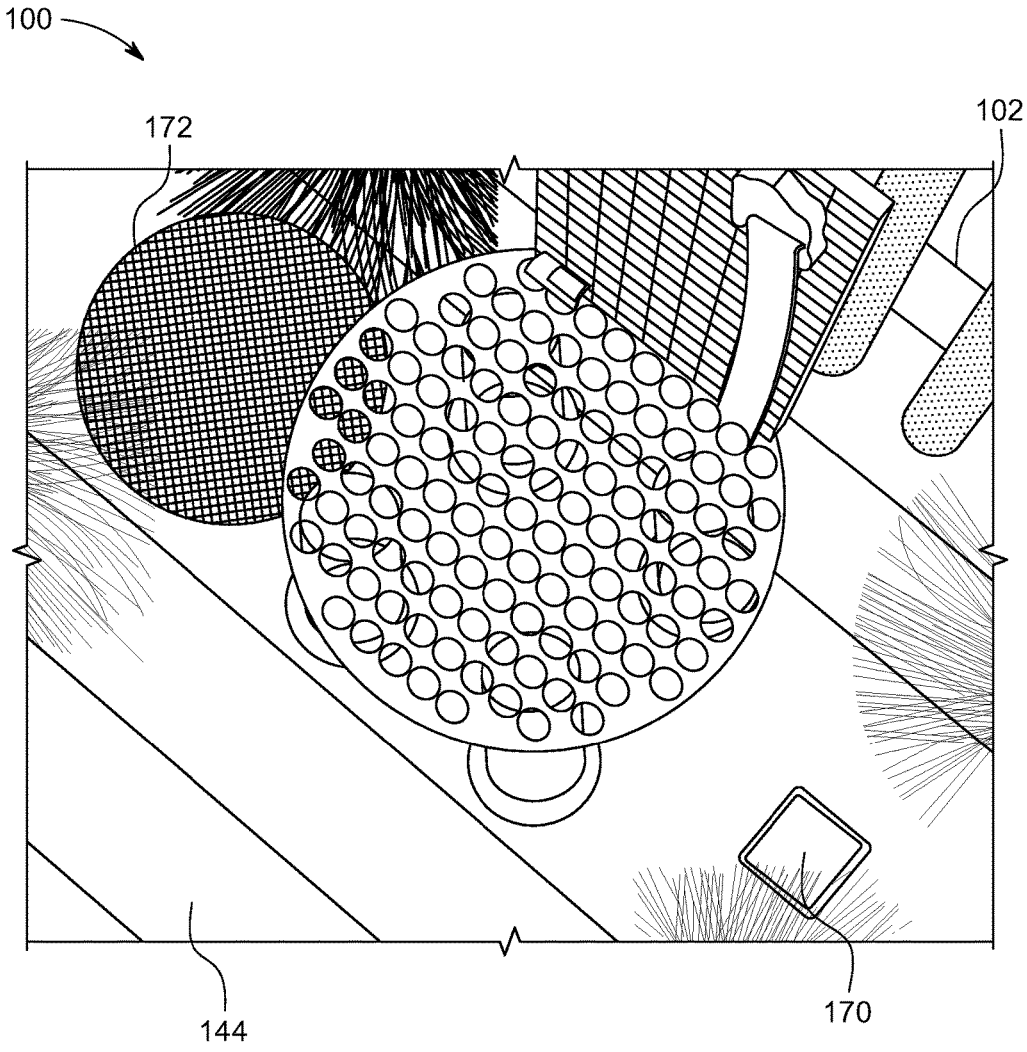
FIG. 16 shows a top view of a chair secured to a base of an automated human washing system, in accordance with one embodiment.

Referring to FIG. 16, in one embodiment, the automated human washing system 100 preferably includes an emergency pedal 170 that is accessible at the top surface 144 of the base 102. The emergency pedal 170 may be engaged for automatically halting the operation of the automated human washing system (e.g., stop dispensing liquid, stop dispending shampoo, stop the heater, stop the blowers, open the door, signal an alarm).

In one embodiment, the automated human washing system 100 preferably includes a drain 172 located on the top surface 144 of the base 102 for draining liquid from the inside of the double walled container of the automated human washing system 100. Some embodiment may have two or more drains. In one embodiment, the drain 172 includes a hole formed in the top surface 144 of the base 102 having a diameter of about 8-11 inches and more preferably about 9.84 inches to provide for easy drainage of liquids from inside the automated human washing system.

Figure 17A:
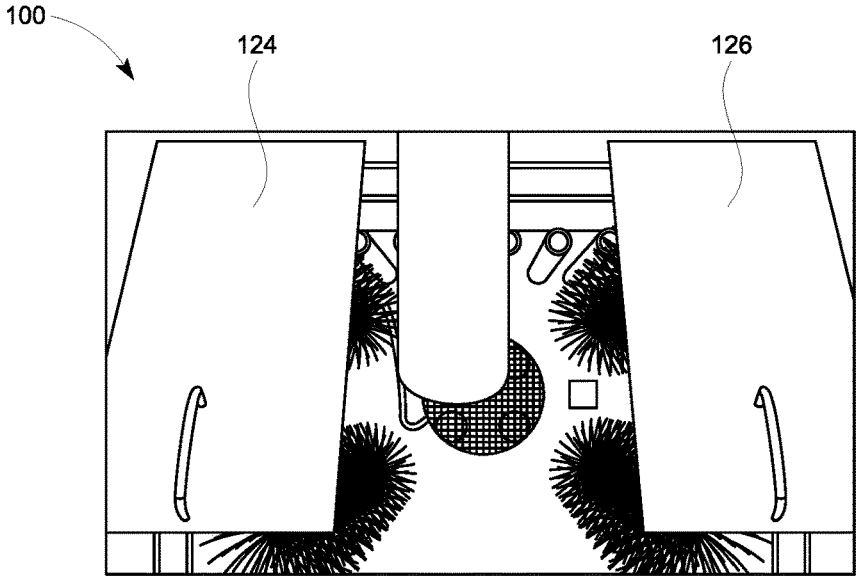
FIG. 17A shows a top cap of an automated human washing system having first and second top lids, in accordance with one embodiment.
Figure 17B:
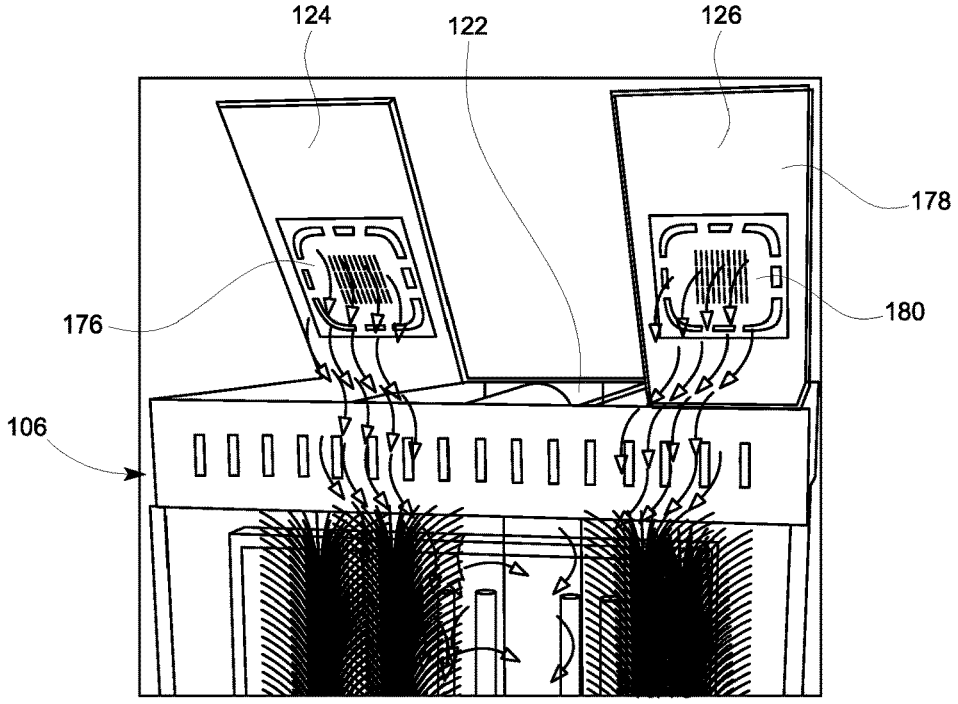
FIG. 17B shows the top cap of the automated human washing system of FIG. 17A with the first and second top lids in an open position, in accordance with one embodiment.

Referring to FIG. 17A, in one embodiment, the top cap 106 (FIG.1) is covered by the first and second top lids 124, 126. The first and second top lids 124 are preferably spaced from one another by a width $W_3$ of about 10-12 inches and more preferably about 11.81 inches. In one embodiment, each of the first and second top lids 124, 126 has a rectangular shape with a length $L_4$ of about 45-50 inches and more preferably about 47.24 inches and a width $W_4$ of about 10-12 inches, and more preferably about 11.81 inches. Referring to FIG. 17B, in one embodiment, the first top lid 124 has an inside surface 174 that faces toward the inside of the double walled container. The first top lid 124 includes a first hot air blower 176 that blows hot, drying air into the top of the double walled container. Similarly, the second top lid 126 includes an inner surface 178 having a hot air dryer 180 mounted thereto for blowing hot, drying air into the top of the double walled container. The first and second top lids 124, 126 have rear edges that are hingedly attached to the rear edge of the top cap 106. The clear top panel 122 preferably extends between the first and second top lids 124, 126.

In one embodiment, in the event of an emergency or a requirement to immediately stop operation of the automated human washing system, an operator or individual inside the double walled container may push either of the first and second top lids 124, 126 to an up position (e.g., an open position), as shown in FIG. 17B to immediately halt operation of the automated human washing system. In addition, in one embodiment, an individual may engage and/or press the emergency pedal 170 (FIG. 16) to immediately halt operation of the automated human washing system.

Figure 18:
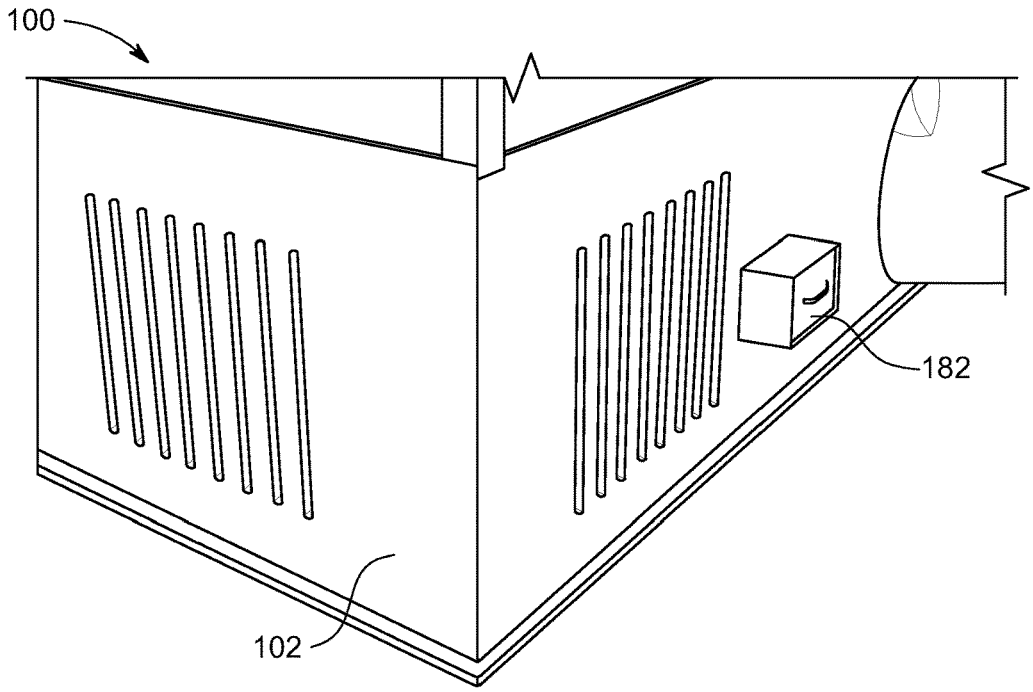
FIG. 18 shows a perspective view of a base of an automate human washing system, in accordance with one embodiment.

Referring to FIG. 18, in one embodiment, an automated human washing system 100 preferably includes a solution reservoir 182 that is associated with the base 102 thereof. The solution reservoir 182 allows an operator to fill the automated human washing system with shampoo or conditioner similar to inserting a cartridge into a printer. In one embodiment, the solution reservoir preferably includes a first compartment adapted to receive shampoo, a second compartment adapted to receive soap, a third compartment adapted to receive conditioner, and a fourth compartment adapted to receive perfume. In one embodiment, the shampoo, soap, conditioner and perfume are poured into the respective compartments. In one embodiment, the solution reservoir 182 may be refilled with the solutions. In one embodiment, the solution reservoir 182 is similar to an inkjet cartridge receptacle that contains inkjet-like elements containing shampoo, soap, conditioner and/or perfume solution that may be introduced into the wash tub during operation of the automated human washing system.

Figure 19:
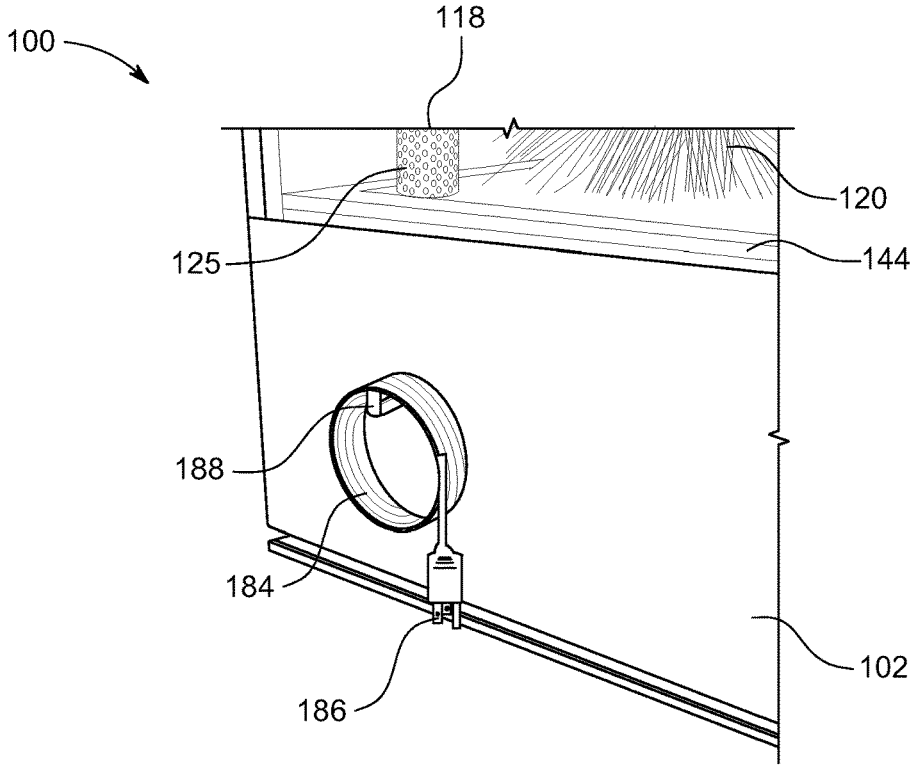
FIG. 19 shows another perspective view of the base of the automated human washing system of FIG. 18.

Referring to FIG. 19, in one embodiment, the automated human washing system 100 preferably includes an electronic power cord 184 having a plug 186 that is insertable into an electrical socket for proving power to the automated human washing system. In one embodiment, the base 102 includes a hook 188 for securing the electrical power cord 184 on the side of the base 102. FIG. 19 shows one of the vertically extending liquid dispensing tubes 118 having a plurality of openings 125 formed therein for dispensing liquid inside the double walled container of the automated human washing system 100. The liquid dispensing tube 118 has a lower end secured to the top face 144 of the base 102. The liquid dispensing tube 118 is preferably arrayed in a vertical configuration that extends along an axis that is substantially perpendicular to the top surface 144 of the base 102. In one embodiment, the automated human washing system 100 also includes one or more cleaning brushes 120 having lower ends secured within cleaning brush tracks provided at the top surface 144 of the base 102. The base 102 preferably includes a motor for moving the cleaning brushes within the tracks during operation of the automated human washing system. In one embodiment, the base 102 contains another motor for pumping liquids such as water, soap, shampoo, conditioner and/or perfume the plurality of openings 125 formed in the vertically extending liquid dispensing tubes 118. The motors are preferably powered by the energy obtained using the electrical power cord 184.

Figure 20:
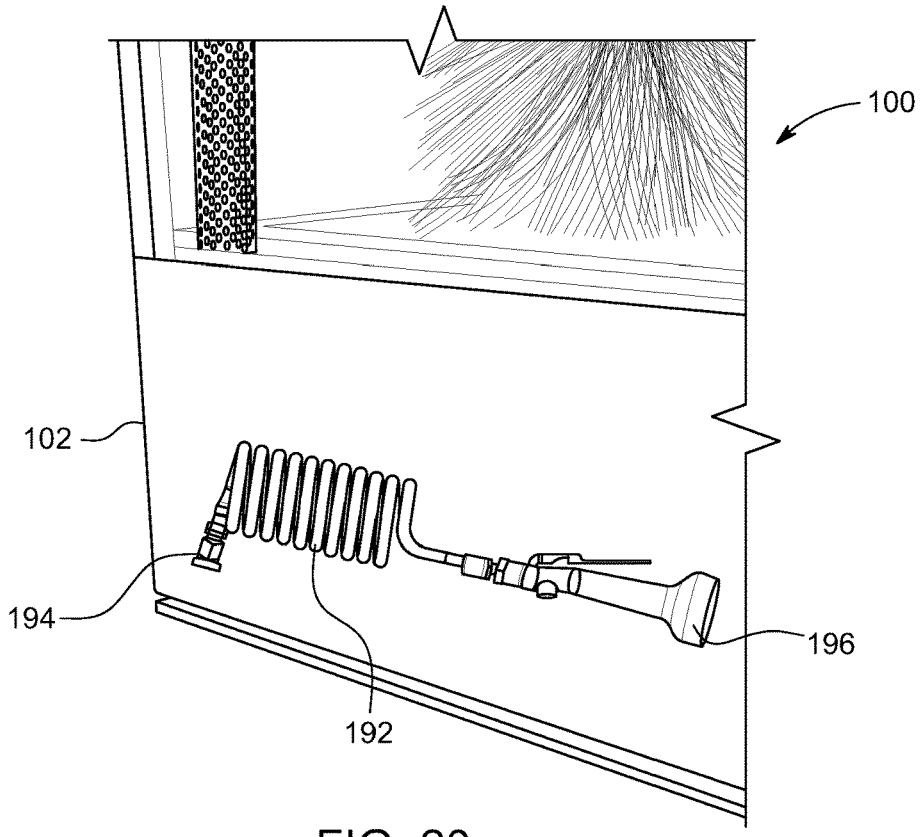
FIG. 20 shows a perspective view of a base of an automated human washing system, in accordance with one embodiment.

Referring to FIG. 20, in one embodiment, the automated human washing system 100 preferably includes a water hose 192 having an attachment end 194 and a dispensing end 196. In one embodiment, the attachment end 194 may be coupled with a water source for dispensing the water from the dispensing end 196. In one embodiment, the water hose 192 may be secured to a side of the base 102. In one embodiment, the water tube 192 has an internal diameter of about 0.5-1.00 inches and more preferably about 0.75 inches. In one embodiment, the water hose 192 has a coiled, elastic structure so that it may be extended or stretched for dispensing water on an individual and then return to its original shape shown in FIG. 20.

Figure 21:
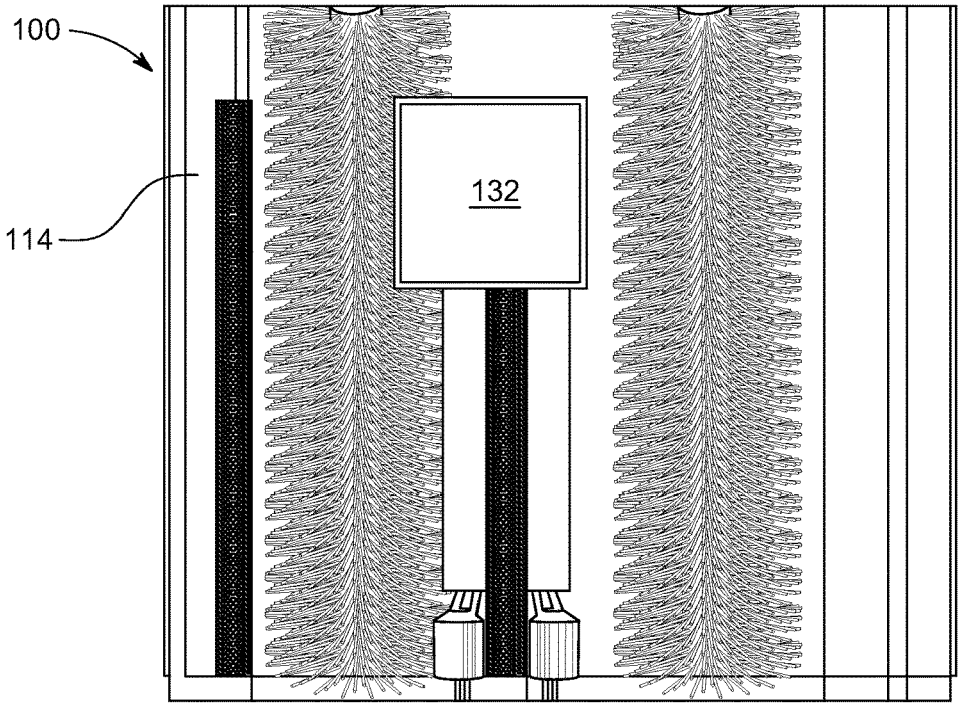
FIG. 21 shows a controller for an automated human washing system, in accordance with one embodiment.

Referring to FIG. 21, in one embodiment, the automated human washing system 100 preferably includes a control panel 132 that is in communication with a central processing unit 210 (FIG. 24) located within the base 102 (FIG. 20) of the automated human washing system. In one embodiment, the control panel 132 is mounted on an exterior surface of one of the outer transparent side walls of the automated automated human washing system. In one embodiment, the control panel 132 is mounted on the outside of the right side wall 114 of the automated automated human washing system. The control panel preferably functions for controlling water supply, soap, shampoo, conditioner, perfume, a timer, water temperature, and drying temperatures during operation of the machine in accordance with commands entered into the control panel by an operator. In one embodiment, the automated human washing system will desirably commence operation of a washing cycle in approximately three (3) minutes after programming the control panel and/or entering a selected wash cycle into the control panel.

Figure 22:
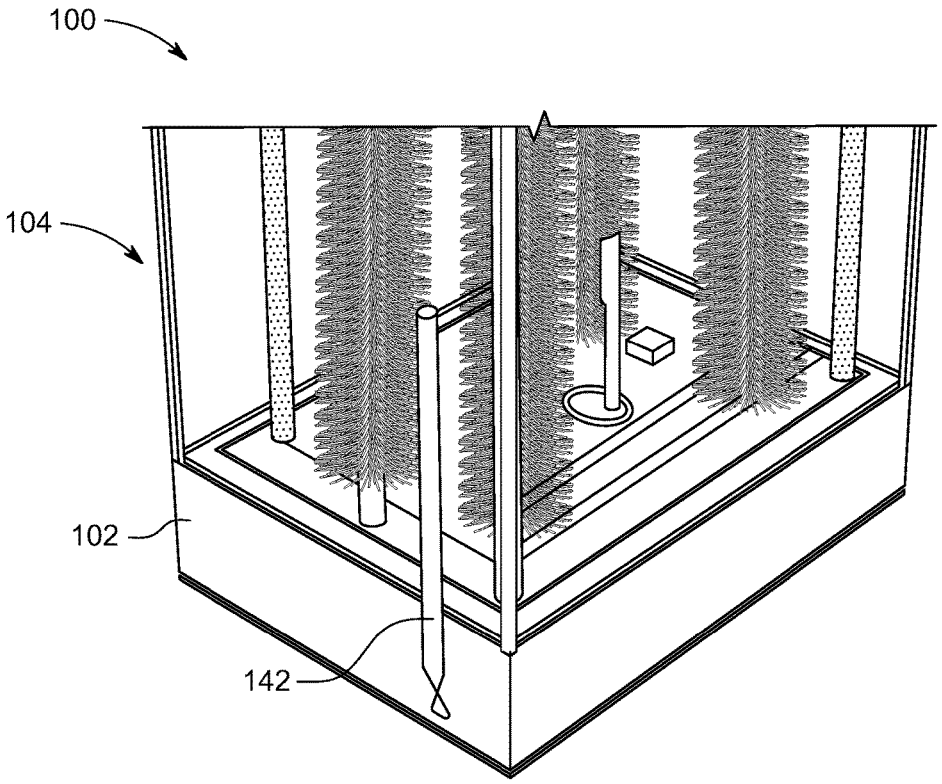
FIG. 22 shows a perspective view of a lower end of an automated human washing system including a drainage tube, in accordance with one embodiment.

Referring to FIG. 22, in one embodiment, an automated automated human washing system 100 preferably includes a water drainage hose 142 that is coupled with the base 102. When water is drained from inside the double walled container of the automated human washing system, the drained water may be dispensed via the water drainage hose 142. In one embodiment, the water drainage hose 142 preferably has an internal diameter of about 1-3 inches and preferably about 2 inches. In one embodiment, the water drainage hole may be coupled with any dispensing drain or a hole located inside a room such as a bathroom in order to drain the water from the automated human washing system. In one embodiment, the water drainage hose 142 is stored beneath the transparent midsection 104 and preferably along the side of the base 102.

Figure 23:
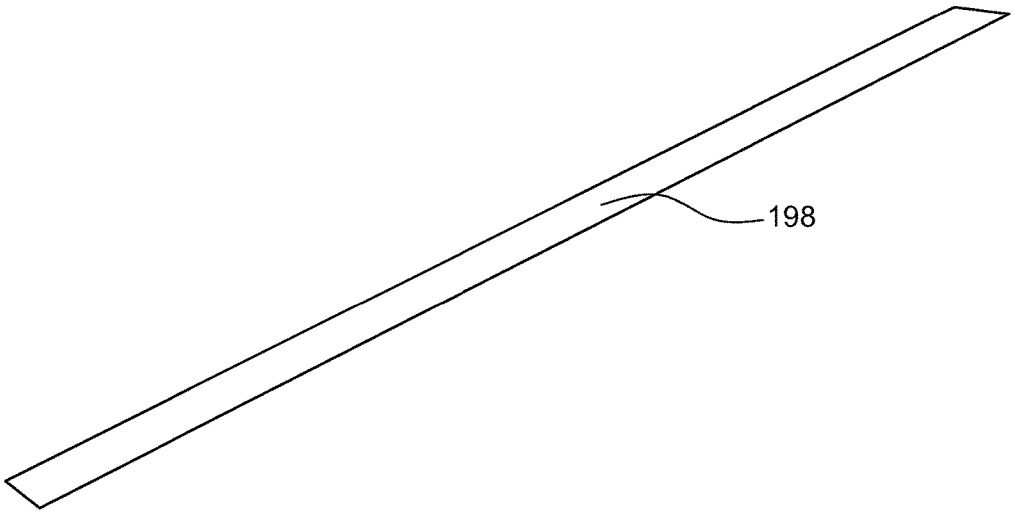
FIG. 23 shows a ramp for an automated human washing system, in accordance with one embodiment.

Referring to FIG. 23, in one embodiment, a ramp 198 may be utilized for providing access to the inside of an automated human washing system. In one embodiment, the ramp may be placed onto an edge of the base 102 (FIG. 22) to enable an individual to walk over the ramp for entering the inside of the automated human washing system. The ramp 198 is preferably aligned with the front door of the automated human washing system. In one embodiment, the ramp may enable an individual in a wheelchair to be wheeled inside the automated human washing system. In one embodiment, the slope of the ramp preferably will not exceed 6.25 degrees. In one embodiment, the ramp preferably has a width of about 20-30 inches and more preferably about 23.62 inches. In one embodiment, the ramp is made of rugged wood material and may have a top surface with surface roughenings or gripping features to prevent slipping and to provide traction between an individual and the top surface of the ramp.

Figure 24:
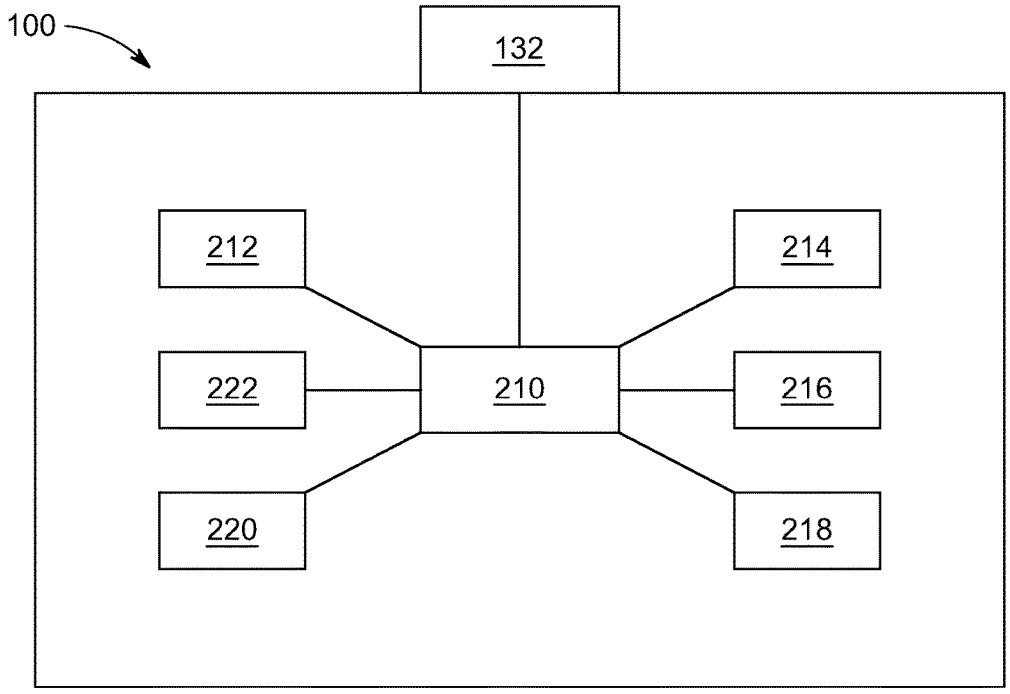
FIG. 24 shows a schematic view of a control system including engines for an automated human washing system, in accordance with one embodiment.

Referring to FIG. 24, in one embodiment, an automated automated human washing system desirably includes a central processing unit 210 that is in communication with the control panel 132 (FIG. 1). The control panel 132 enables an operator to program or operate the automated human washing system. The central processing unit 210 is preferably in communication with a first engine 212 for controlling movement of the cleaning brushes, a second engine 214 for pumping water into the automated human washing system, and draining water from the automated human washing system, a third engine 216 for pumping solutions such as soap, shampoo, conditioner and/or perfume into the liquid dispensing tubes of the automated human washing system, a fourth engine 218 for providing drying hot air and/or high pressure air through the hot air blowers provided on the underside of the first and second top lids, a fifth engine 220 including a hydraulic lift for raising and lowering the height of a chair inserted into the chair leg openings provided in the top surface of the base, and a sixth engine 222 that controls a dispensing mechanism for controlling the amount of shampoo, soap, and/or conditioner introduced into the automated human washing system. In one embodiment, all of the engines shown in FIG. 24 are disposed within the base 102 (FIG. 1) located at the bottom of the automated human washing system. In one embodiment, the base has a height of about 10-12 inches and more preferably about 11.81 inches.

Figure 25:
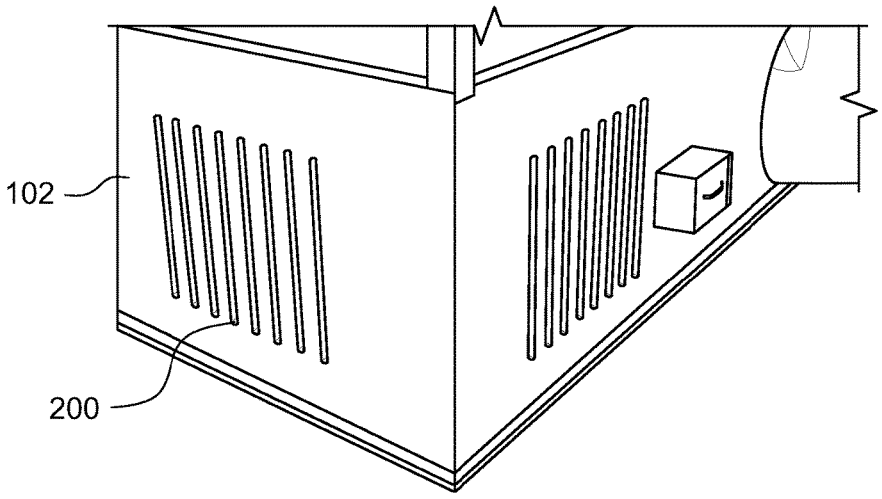
FIG. 25 shows a perspective view of a base at a lower end of a human washing machine, in accordance with one embodiment.

Referring to FIG. 25, in one embodiment, the base 102 includes vents 200 for venting the heat generated by the engines from the base 102.

While the foregoing is directed to embodiments of the present invention, other and further embodiments of the invention may be devised without departing from the basic scope thereof, which is only limited by the scope of the claims that follow. For example, the present invention contemplates that any of the features shown in any of the embodiments described herein, or incorporated by reference herein, may be incorporated with any of the features shown in any of the other embodiments described herein, or incorporated by reference herein, and still fall within the scope of the present invention.

What is claimed is:

1. An automated human washing system comprising:

an enclosure including a base, a midsection and a top cap;

said enclosure including a front wall having a front door moveable between open and closed positions;

a plurality of liquid dispensing tubes having lower ends secured to said base and upper ends spaced from said base, wherein each said liquid dispensing tube has a plurality of openings adapted for introducing liquid into said enclosure;

a plurality of elongated cleaning brushes having lower ends secured to said base and upper ends spaced from said base, wherein said liquid dispensing tubes are spaced from one another adjacent outer edges of said base, and wherein said elongated cleaning brushes are located inside a perimeter defined by said liquid dispensing tubes;

said top cap including first and second top lids moveable between closed positions for covering an upper end of said enclosure and open positions for providing access to the upper end of said enclosure;

a main water dispensing faucet located between said first and second top lids adjacent an upper end of said enclosure for introducing water into the upper end of said enclosure;

a drain located at a lower end of said enclosure for removing liquid from said enclosure;

a first engine located in said base for pumping liquid through said liquid dispensing tubes into said enclosure;

a second engine located in said base for moving said elongated cleaning brushes over a top surface of said base;

a control system disposed in said base for automatically operating said human washing system including controlling said first and second engines.

2. The system as claimed in claim 1, wherein said enclosure has side walls that are transparent.

3. The system as claimed in claim 1, wherein said enclosure is a double-walled structure.

4. The system as claimed in claim 1, wherein said lower end of said enclosure forms a water tight seal with said base.

5. The system as claimed in claim 1, further comprising:

chair leg openings formed in a top surface of said base;

moveable platforms disposed inside said chair leg openings that are configured to move up and down relative to the top surface of said base;

a chair having legs positioned over the top surface of said base, wherein said legs of said chairs are inserted into said chair leg openings, wherein the height of said chair relative to the top surface of said base is adjustable by moving said moveable platforms.

6. The system as claimed in claim 1, further comprising a hot air blower located on an underside of at least one of said first and second top lids.

7. The system as claimed in claim 6, wherein said first and second top lids open and close independently of one another, wherein said hot air blower comprises a first hot air blower located on an underside of said first top lid and a second hot air blower located on an underside of said second top lid, and wherein said main water dispensing faucet passes through an opening extending between said first and second top lids.

8. The system as claimed in claim 7, further comprising:

said control system including a central processing unit containing one or more operational protocols for controlling operation of said automated human washing system, one or more memory devices, and circuitry for controlling operation of said automated human washing system;

a first engine for controlling movement of said elongated cleaning brushes;

a second engine for pumping water into said enclosure of said automated human washing system;

a third engine for pumping solutions selected from the group consisting of soap, shampoo and conditioner into said liquid dispensing tubes of said automated human washing system.

9. The system as claimed in claim 8, further comprising:

a fourth engine for providing drying hot air and/or high pressure air through said hot air blowers provided on the underside of the first and second top lids; and a fifth engine including a hydraulic lift for raising and lowering the height of a chair inserted into said chair leg openings provided in the top surface of said base.

10. The system as claimed in claim 1, wherein said top cap comprises a plurality of spaced vent openings formed in sides walls of said top cap.

11. The system as claimed in claim 1, further comprising:

a water inlet tube coupled with said enclosure and being in communication with said liquid dispensing tubes and said main water dispensing faucet for supplying water to said enclosure;

a drainage tube coupled with said enclosure and being in communication with a drain for removing water from said enclosure.

12. The system as claimed in claim 1, wherein each said liquid dispensing tube extends vertically between the lower and upper ends of said enclosure, and wherein each said liquid dispensing tube has a plurality of spaced openings for introducing water into said enclosure.

13. The system as claimed in claim 1, further comprising a solution reservoir located on said base, wherein said solution reservoir includes at least one of a soap compartment, a shampoo compartment, and a conditioner compartment.

14. The system as claimed in claim 1, further comprising:

cleaning brush slots formed in a top surface of said base;

lower ends of said elongated cleaning brushes being inserted into said cleaning brush slots, wherein said elongated cleaning brushes are configured to move back and forth over the top surface of said base by moving through said cleaning brush slots.

15. An automated human washing system comprising:

an enclosure including a base, a midsection and a top cap;

said enclosure including a front wall having a front door moveable between open and closed positions;

a plurality vertically extending tubes having lower ends secured to said base, wherein each said vertically extending tube has a plurality of openings adapted for introducing liquid into said enclosure;

a plurality of vertically extending, elongated cleaning brushes having lower ends secured to said base, wherein said vertically extending tubes are spaced from one another for defining an outer perimeter, and wherein said vertically extending, elongated cleaning brushes are located inside the outer perimeter defined by said vertically extending tubes;

said top cap including first and second top lids moveable between closed positions for covering an upper end of said enclosure and open positions for providing access to the upper end of said enclosure;

a main water dispensing faucet located between said first and second top lids for introducing water into the upper end of said enclosure;

a drain located at a lower end of said enclosure for removing liquid from said enclosure;

an engine located in said base for moving said elongated cleaning brushes over a top surface of said base;

a control system disposed in said base for automatically operating said human washing system including controlling said engine.

* * * * *